US007902456B2

(12) United States Patent
Witthoft et al.

(10) Patent No.: US 7,902,456 B2
(45) Date of Patent: Mar. 8, 2011

(54) THERMAL MASS COMPENSATED DIELECTRIC FOAM SUPPORT STRUCTURES FOR COAXIAL CABLES AND METHOD OF MANUFACTURE

(75) Inventors: Mark Witthoft, Lockport, IL (US); Alan Moe, Hickory, NC (US)

(73) Assignee: Andrew LLC, Hickory, NC (US)

( * ) Notice: Subject to any disclaimer, the term of this patent is extended or adjusted under 35 U.S.C. 154(b) by 97 days.

(21) Appl. No.: 12/235,799

(22) Filed: Sep. 23, 2008

(65) Prior Publication Data

US 2009/0020310 A1 Jan. 22, 2009

Related U.S. Application Data

(63) Continuation-in-part of application No. 11/306,793, filed on Jan. 11, 2006, now Pat. No. 7,446,257.

(51) Int. Cl.
*H01B 7/00* (2006.01)

(52) U.S. Cl. ..... 174/28; 174/102 R

(58) Field of Classification Search ..... 174/36, 174/28, 102 R, 110 R, 110 F, 110 FC, 102 D, 174/110 PM, 120 R, 120 AR; 428/383, 461
See application file for complete search history.

(56) References Cited

U.S. PATENT DOCUMENTS

| | | | | |
|---|---|---|---|---|
| 3,173,390 | A | 3/1965 | Lamons | |
| 3,173,990 | A * | 3/1965 | Lamons | 174/102 R |
| 4,107,354 | A | 8/1978 | Wilkenloh et al. | |
| 6,239,377 | B1 | 5/2001 | Nishikawa | |
| 6,756,538 | B1 | 6/2004 | Murga-Gonzalez et al. | |
| 6,800,809 | B2 | 10/2004 | Moe et al. | |
| 2003/0011606 | A1 * | 1/2003 | Nonomura et al. | 345/547 |
| 2004/0007308 | A1 * | 1/2004 | Houston et al. | 156/54 |
| 2004/0151446 | A1 * | 8/2004 | Wyatt et al. | 385/100 |
| 2004/0222009 | A1 * | 11/2004 | Blew et al. | 174/110 F |

* cited by examiner

*Primary Examiner* — William H Mayo, III
(74) *Attorney, Agent, or Firm* — Babcock IP, PLLC

(57) ABSTRACT

Thermal mass compensated foam support structures for coaxial cables such as inner conductors and or inner conductor support structures. The foam support structures provided with an adhesive solid or high density foam polymer or blend layer to increase the thermal mass of the support structure enough to allow the foam to surround the adhesive solid or high density foam polymer or blend layer without forming unacceptably large voids in the foam dielectric as the foam dielectric cures.

12 Claims, 5 Drawing Sheets

THERMAL MASS COMPENSATED DIELECTRIC FOAM SUPPORT STRUCTURES FOR COAXIAL CABLES AND METHOD OF MANUFACTURE

CROSS REFERENCE TO RELATED APPLICATIONS

This application is a continuation-in-part of U.S. patent application Ser. No. 11/306,793 titled " Coaxial Cable with Fine Wire Inner Conductor", filed Jan. 11, 2006 now U.S. Pat. No. 7,446,257 by Mark Witthoft, currently pending and hereby incorporated by reference in the entirety.

BACKGROUND OF THE INVENTION

Prior attempts at coating support structures having a low thermal mass with dielectric foam, such as the fine wire inner conductor or plastic rod inner conductor support of a coaxial cable, have suffered from an unacceptably high number of longitudinal voids in the applied dielectric foam, proximate the support structure.

A prior art coaxial cable with void(s) 5 around the fine wire inner conductor 10, for example as shown in FIG. 1, is difficult to prepare for interconnection because the exact inner conductor position is variable. Also, in contrast to a cable where the inner conductor 10 is fully supported by the foam dielectric 15, any pressure upon the inner conductor 10 during interconnection may cause it to bend and collapse into the void(s) 5, away from the cable end.

Commonly owned U.S. Pat. No. 6,800,809, titled "Coaxial Cable and Method of Making Same", by Moe et al, issued Oct. 5, 2004, hereby incorporated by reference in the entirety, discloses a coaxial cable structure wherein the inner conductor is formed by applying a metallic strip around a cylindrical filler and support structure comprising a cylindrical plastic rod support structure with a foamed dielectric layer there around. The resulting inner conductor structure has significant materials cost and weight savings compared to coaxial cables utilizing solid metal inner conductors.

Competition within the coaxial cable industry has focused attention upon reducing materials and manufacturing costs, electrical characteristic uniformity, defect reduction and overall improved manufacturing quality control.

Therefore, it is an object of the invention to provide a coaxial cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Continuous production manufacture of coaxial cables including dielectric foam applied about an inner conductor or other supporting structure having a low thermal mass has previously either included an unacceptably high number of longitudinal voids appearing in the dielectric foam, proximate the inner structure, or necessitated design changes such as increasing the size and thus thermal mass of the support element. The inventor(s) have recognized the reason these voids appear.

The foam dielectric area of a high impedance cable will be larger than in an otherwise similar low impedance cable. During the foam dielectric expansion step, the foam dielectric relies upon the thermal mass of the inner conductor to assist with the curing of the dielectric foam towards the center of the cable rather than just towards a cooling quench flowing around the exterior. Even if a traditional thin adhesive coating of an unexpanded plastic is present around the inner conductor, if insufficient inner conductor thermal mass is present to receive heat transfer from the dielectric foam, i.e. cool the core of the foam dielectric as it is expanded, the foam dielectric will pull away from the inner conductor, creating voids around the inner conductor. Similarly, the inner conductor support structure of U.S. Pat. No. 6,800,809 has an oversized diameter—to provide sufficient thermal mass to obtain a uniform foam dielectric layer without unacceptably large voids.

The inventor's research has verified that applying a thick outer layer of adhesive resin such as a solid or high density foam polymer or blend around the foam dielectric support structure increases the thermal mass and improves the combined support structure and dielectric foam combination mechanical characteristics during further manufacturing steps. The increased thermal mass and improved mechanical characteristics of the coated support structure results in a fine wire inner conductor coaxial cable with significant improvements in uniformity of characteristic impedance and ease of use.

Figure 1:
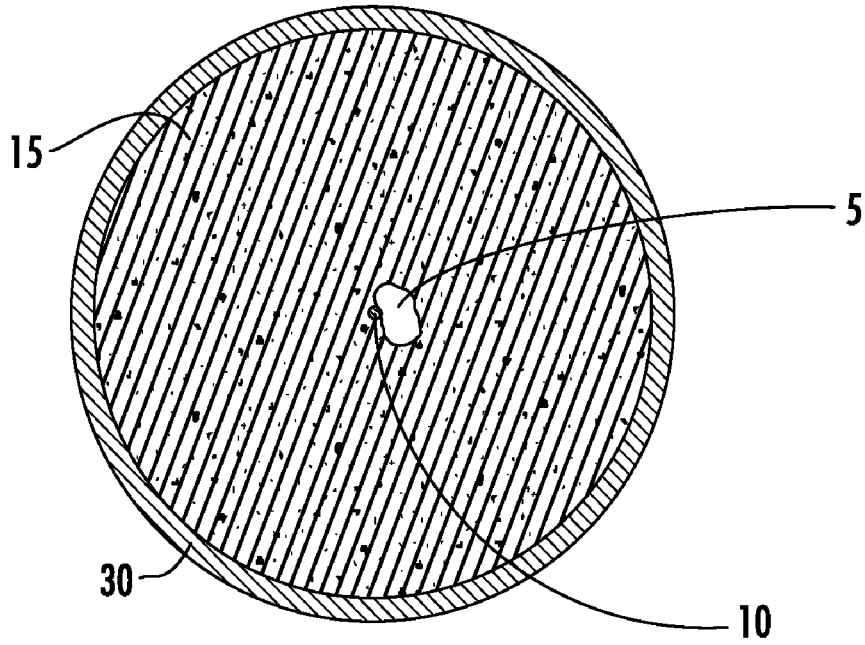
FIG. 1 (PRIOR ART)
FIG. 1 is a schematic end view representation of a prior art fine center conductor coaxial cable.
Figure 2:
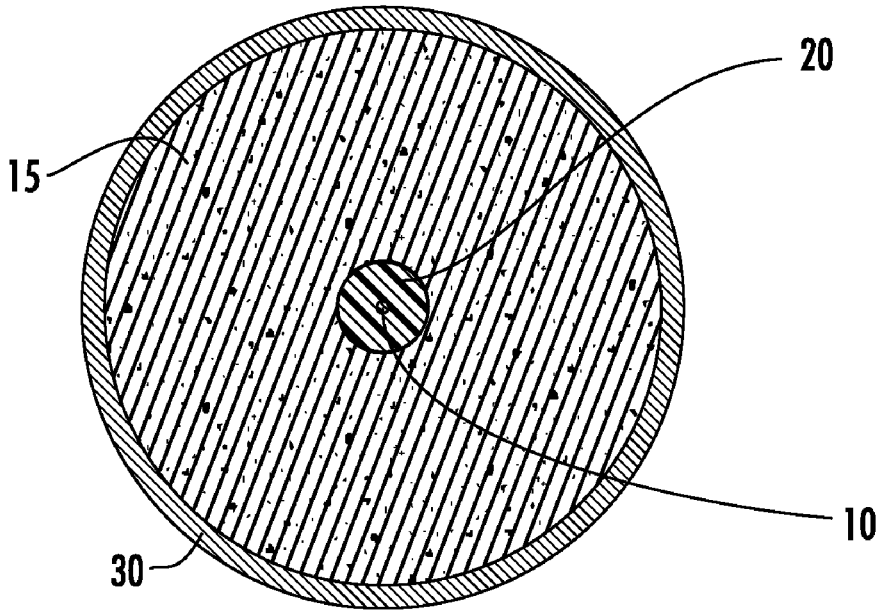
FIG. 2 is a schematic end view representation of a fine center conductor coaxial cable according to the invention.

As shown in FIG. 2, a first exemplary embodiment of the invention has a fine wire inner conductor 10 surrounded by a, for example, polyolefin adhesive resin coating, or other solid or high density foam polymer or blend layer 20 that has a thickness at least 30% of the inner conductor 10 diameter. The inner conductor 10 of the first exemplary embodiment shown in FIG. 2 has an inner conductor 10 diameter of 0.02 inches. Therefore, the solid or high density foam polymer or blend layer 20 according to the invention should be at least 0.06 inches thick. In this embodiment, after the solid or high density foam polymer or blend layer 20 is applied to the inner conductor 10, the resulting coated inner conductor 25 will have an overall exterior diameter of at least 0.32 inches.

The solid or high density foam polymer or blend layer 20 is surrounded by a foam dielectric 15 that is surrounded by the outer conductor 30. In the exemplary embodiment, the foam dielectric 15 and solid or high density foam polymer or blend layer 20 are polyolefin resins selected to have compatible molecular properties. The solid or high density foam polymer or blend layer 20 may also be selected to provide suitable adhesion to the inner conductor 10 as well as acceptable signal loss characteristics.

The fine wire inner conductor 10 of the first embodiment may have a steel core for improved tensile strength. Copper or other high conductivity metal electroplating may be applied to the steel core to protect it from corrosion and improve conductivity. An outer layer of tin may also be applied to simplify soldered connections to the inner conductor.

The outer conductor 30 may be a solid aluminum or copper material with or without corrugations, as desired. Alternatively, foil and or braided outer conductor(s) 30 may also be applied. If desired, a plastic outer protective sheath may be added.

Figure 3:
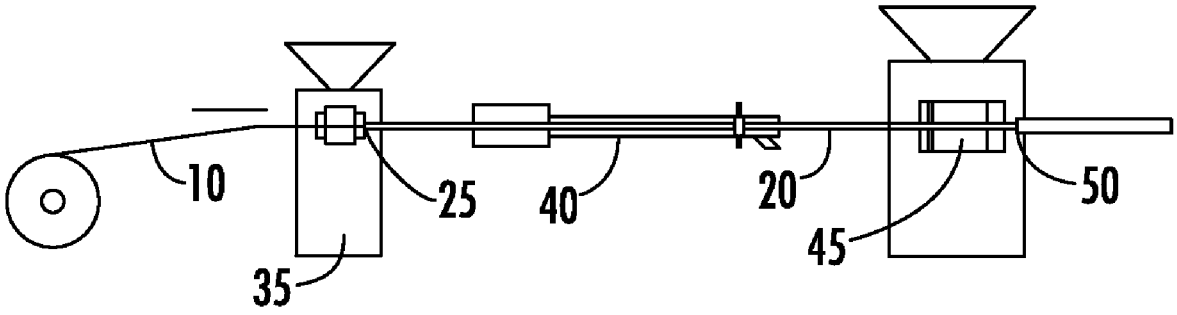
FIG. 3 is a schematic manufacturing process diagram.

During a continuous manufacturing process according to the present embodiment, as shown in FIG. 3, the fine wire inner conductor 10 is delivered to a first extruder 35 that applies the solid or high density foam polymer or blend layer 20 around the inner conductor 10 to a thickness at least 30% of the inner conductor 10 diameter. Passage through a cooling tube 40 or other cooling mechanism cools the conductor 10 and surrounding hot solid or high density foam polymer or blend layer 20 (coated inner conductor 25). Where sufficient process space is available, the cooling mechanism may be formed as an extended transport path through open air.

Figure 4:
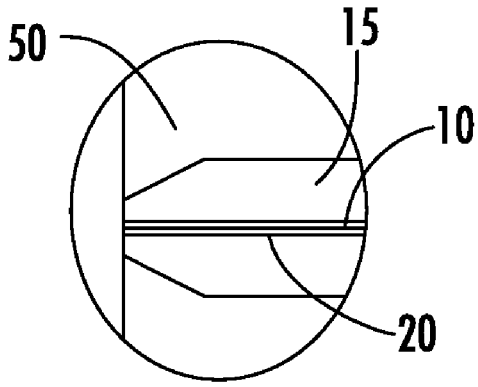
FIG. 4 is a close up of the quench area 50 of FIG. 3.

A second extruder 45 applies a foam dielectric resin layer to the coated inner conductor 25 that expands to form foam dielectric 15 upon exiting the second extruder 45. Expansion is controlled by passage through a quench area 50, as shown in FIG. 4, until the foam dielectric 15 reaches its desired expansion. Because the inner conductor 10, coated by the solid or high density foam polymer or blend layer 20, has a significantly higher thermal mass than prior high impedance fine wire inner conductor coaxial cables, the inner conductor 10 and solid or high density foam polymer or blend layer 20 is able to draw heat from the hot foam dielectric 15 as it expands. Thereby, the formation of void(s) 5 between the coated inner conductor 25 and the foam dielectric 15 that are larger than a cell size of the dielectric foam are minimized and or essentially eliminated.

The foam dielectric 15 coated inner conductor 25 may be cured for a desired period or passed directly to the outer conductor 30 application process (not shown). The desired outer conductor 30 may be applied, for example by seam welding a solid metal outer conductor 30, coaxial with the inner conductor 10, around the foam dielectric 15. Methods for applying outer conductor 30 to a foam dielectric 15 coated inner conductor 25 are well known in the art and as such are not described in further detail here.

To minimize material requirements, the solid or high density foam polymer or blend layer 20 thickness, and thereby the thermal mass of the plastic rod 55 and solid or high density foam polymer or blend layer 20 combination may be adjusted until an acceptable thermal mass is present to generate the desired foam dielectric 15 application parameters and thereby the finished coaxial cable characteristics.

Figure 5:
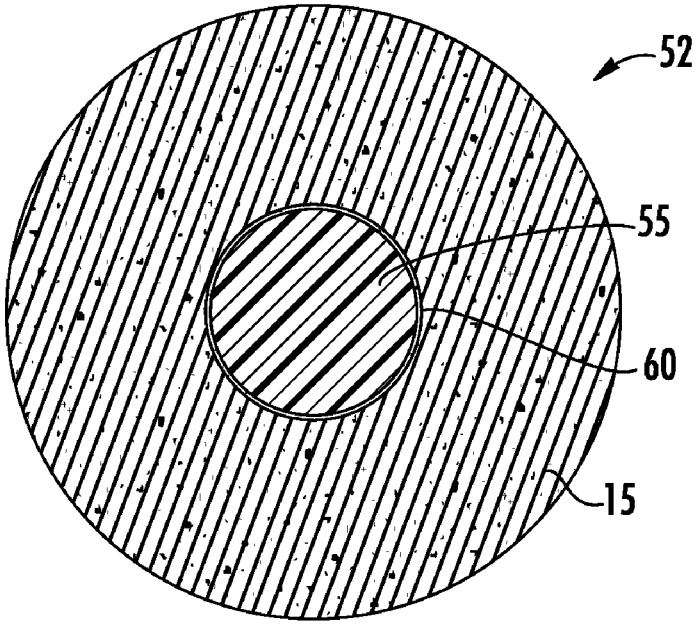
FIG. 5 (PRIOR ART)
FIG. 5 is a schematic end view representation of a prior art support structure utilizing a plastic rod.

With respect to an inner conductor support structure 52 according to U.S. Pat. No. 6,800,809, to avoid unacceptable voids and or position shift between the plastic rod 55 and the layer of foamed dielectric 15, the plastic rod 55 has previously been applied with an increased diameter, for example as shown in FIG. 5. Because the materials cost of the plastic rod 55 per unit of cross sectional area is much higher than the materials cost for adhesive 60 and/or foam dielectric 15 polymer layers, as the diameter of the plastic rod 55 is increased, the material cost of the resulting inner conductor support structure also significantly increases.

Figure 6:
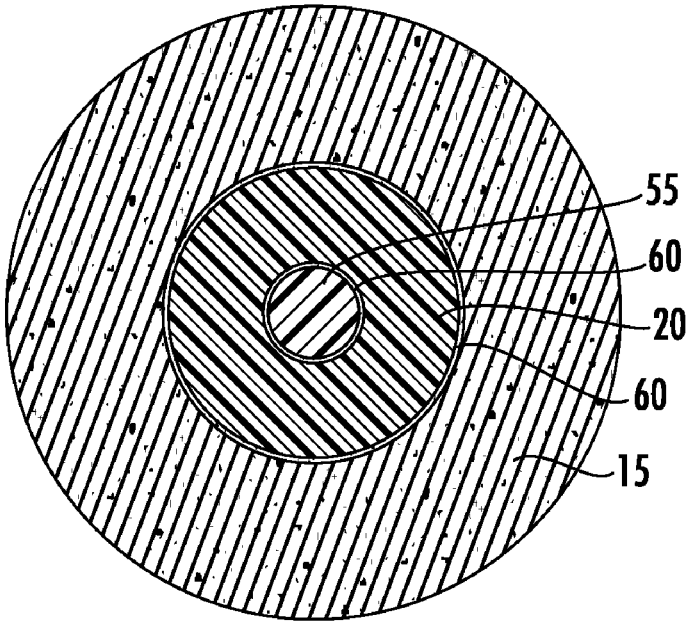
FIG. 6 is a schematic end view representation of a support structure according to the invention.
Figure 7:
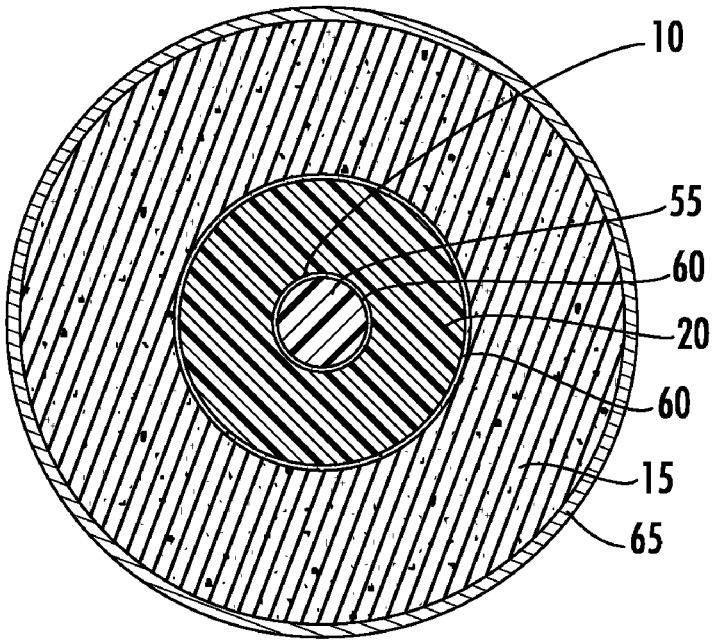
FIG. 7 is a schematic end view representation of an inner conductor structure incorporating the support structure of FIG. 6.

Although the plastic rod 55 may have a larger diameter than a fine wire inner conductor 10 described herein above, plastic material generally has a lower thermal mass per cross sectional area than metal. Therefore, the inventors have also observed surrounding foam dielectric 15 void creation and or position shift problems with plastic rods 55 having significantly larger diameters. As with a fine wire inner conductor 10, applying a solid or high density foam polymer or blend layer 20 to the plastic rod 55 increases the thermal mass of the plastic rod 55, enabling application of a significantly smaller plastic rod 55 diameter, for example as shown in FIGS. 6 and 7, without encountering unacceptable low thermal mass foam dielectric 15 application void defects.

To improve adhesion between the plastic rod 55 and the solid or high density foam polymer or blend layer 20 an intermediary adhesive layer 60 may be applied. Similarly, an intermediary adhesive layer 60 may be applied between the solid or high density foam polymer or blend layer 20 and the foamed dielectric 15.

In a plastic rod 55 support structure 52 embodiment, the inner conductor 10 is further formed by surrounding and or otherwise metalizing the outer diameter of the entire plastic rod support structure with metal 65, applied for example by seam welding a metal strip applied around the outer diameter of the foam dielectric 15, as is well known in the art.

The diameter of the inner conductor 10 for a coaxial cable is generally selected according to the desired coaxial cable structural and impedance characteristics. Within the largest diameter commonly manufactured coaxial cable including a conventional plastic rod inner conductor supporting structure such as disclosed by U.S. Pat. No. 6,800,809, the plastic rod may be required to be as large as 3.5 mm in diameter. According to the invention, the diameter of the plastic rod 55 may be dramatically reduced. For example, a 3.5 mm plastic rod 55 may be replaced with a plastic rod 55 with a diameter of 1.0 mm or less by applying a solid or high density foam polymer or blend layer 20 with a thickness of approximately 30 percent of the selected plastic rod 55 diameter.

As the diameter of the plastic rod 55 is reduced, tensile strength limitations of the plastic rod material may become significant. Examples of high tensile strength plastic rod(s) 55 include Kevlar fibers and or glass reinforced plastic. Where the plastic rod 55 is provided in a high strength polymer material with suitable tensile strength characteristics, the plastic rod 55 diameter may be further reduced and the solid or high density foam polymer or blend layer thickness increased, for example to 50% or more of the plastic rod 55 diameter.

A method for manufacturing the inner conductor support structure 52 is analogous to the procedure for preparing the fine wire inner conductor 10 coated with a solid or high density foam polymer or blend layer 20, herein above, with the plastic rod 55 replacing the fine wire inner conductor 10 and adjusting the thickness of the layers accordingly to generate an inner conductor 10 structure that is then applied as an input to a traditional production process to produce a completed coaxial cable. Additional steps in the production of the inner conductor 10 structure may include the intermediate coating of the plastic rod 55 and/or the solid or high density foam polymer or blend layer 20 outer diameter(s) with an additional intermediary adhesive layer 60, if desired.

The invention has been demonstrated with respect to a fine wire inner conductor 10 and plastic rod 55 support structure 52 for an inner conductor exemplary embodiment(s). One skilled in the art will appreciate that the cable design and manufacturing process herein is applicable to coaxial cables having a foam dielectric thickness corresponding to a desired characteristic impedance and solid inner conductors of up to 0.1 inch in conductor diameter. For coaxial cables having thicker solid metal inner conductors, the thermal mass of the inner conductor 10, uncoated, should be sufficient to avoid the appearance of the void(s) 5 described herein, during curing of the foam dielectric 15 as long as the inner conductor 10 is not delivered to the second extruder 45 for foam dielectric 15 coating at an excessive temperature.

Figure 8:
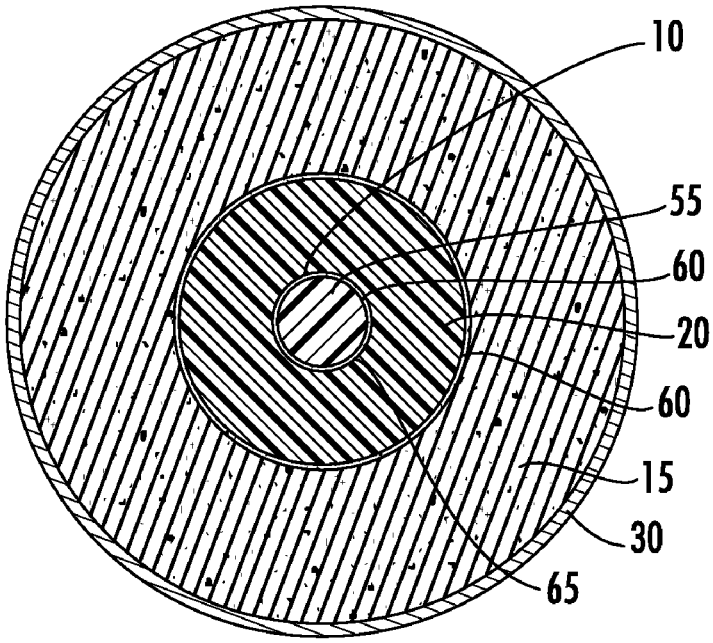
FIG. 8 is a schematic end view representation of an exemplary coaxial cable with a low thermal mass inner conductor structure according to the invention.
Figure 9:
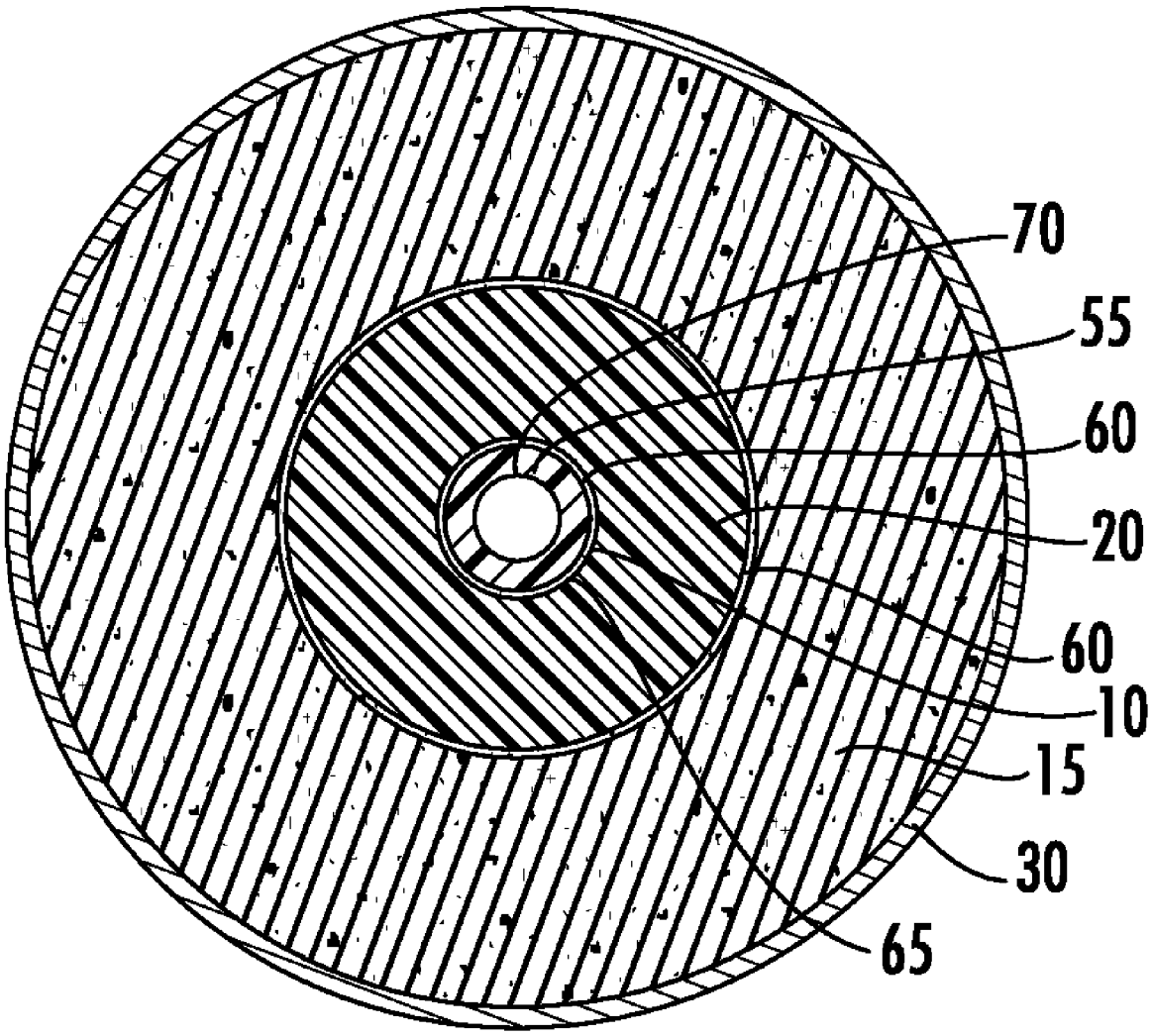
FIG. 9 is a schematic representation of an alternative exemplary coaxial cable with a low thermal mass inner conductor structure according to the invention.

One skilled in the art will recognize that the invention is also applicable to other coaxial cable inner conductor 10 structures having a low thermal mass, such as a plastic rod 55 or tube 70 with a metal 65 outer diameter as shown for example in FIGS. 8 and 9. In this instance, the diameter of the inner conductor 10 is not a limitation of the solid or high density foam polymer or blend layer 20 thickness. Instead, the solid or high density foam polymer or blend layer 20 may be applied at thicknesses selected to achieve a desired thermal mass and thereby the void minimizing effect during dielectric foam 15 application, as described herein above.

The metal 65 outer diameter of the plastic rod 55 may be applied by metalizing the plastic rod 55, for example, by seam welding a metal strip folded around the plastic rod 55, coating, depositing and or plating operations. Alternatively, the metalizing may be via application of a metallic foil upon the outer diameter of the plastic rod 55 or tube 70.

Although the manufacturing process is described as a continuous process, the process may be divided into several discrete sections with work in progress from each section stored before feeding the next section, without departing from the invention as claimed.

Table of Parts

| | |
|---|---|
| 5 | void |
| 10 | inner conductor |
| 15 | foam dielectric |
| 20 | solid or high density foam polymer or blend layer |
| 25 | coated inner conductor |
| 30 | outer conductor |
| 35 | first extruder |
| 40 | cooling tube |
| 45 | second extruder |
| 50 | quench area |
| 52 | support structure |
| 55 | plastic rod |
| 60 | adhesive layer |
| 65 | metal |
| 70 | tube |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial cable, comprising:

an inner conductor; an adhesive solid or high density foam polymer or blend surrounding the inner conductor having a thickness at least 30 percent of the inner conductor diameter;

a foam dielectric surrounding the adhesive solid or high density foam polymer or blend; and an outer conductor surrounding the foam dielectric.

2. The coaxial cable of claim 1, wherein the adhesive solid or high density foam polymer or blend is dimensioned to increase a thermal mass of the adhesive high density polymer coated inner conductor to a level which cures the foam dielectric without forming voids substantially greater than a cell size of the foam dielectric as the foam dielectric cures.

3. The coaxial cable of claim 1, wherein the inner conductor is a metalized plastic rod.

4. The coaxial cable of claim 1, wherein the inner conductor is a metalized plastic tube.

5. An inner conductor support structure for a coaxial cable, comprising:

a plastic rod;

an adhesive solid or high density foam polymer or blend surrounding the plastic rod having a thickness at least 30 percent of the plastic rod diameter; and a foam dielectric surrounding the adhesive solid or high density foam polymer or blend.

6. The inner conductor support structure of claim 5, wherein the plastic rod is a glass reinforced plastic rod.

7. The inner conductor support structure of claim 5, further including an adhesive coating between the plastic rod and the adhesive solid or high density foam polymer or blend.

8. The inner conductor support structure of claim 5, further including an adhesive coating between the adhesive solid or high density foam polymer or blend and the dielectric foam.

9. The inner conductor support structure of claim 5, further including a metal layer surrounding the adhesive solid or high density foam polymer or blend.

10. A coaxial cable, comprising:

an inner conductor;

an adhesive solid or high density foam polymer or blend surrounding the inner conductor;

a foam dielectric surrounding the adhesive solid or high density foam polymer or blend; and an outer conductor surrounding the foam dielectric;

the adhesive solid or high density foam polymer or blend having a thickness dimensioned to increase a thermal mass of the adhesive high density polymer coated inner conductor to a level which cures the foam dielectric without forming voids substantially greater than a cell size of the foam dielectric as the foam dielectric cures.

11. The coaxial cable of claim 10, wherein the inner conductor is a metalized plastic rod.

12. The coaxial cable of claim 10, wherein the inner conductor is a metalized plastic tube.

* * * * *

UNITED STATES PATENT AND TRADEMARK OFFICE

CERTIFICATE OF CORRECTION

PATENT NO. : 7,902,456 B2
APPLICATION NO. : 12/235799
DATED : March 8, 2011
INVENTOR(S) : Mark Witthoft and Alan Moe It is certified that error appears in the above-identified patent and that said Letters Patent is hereby corrected as shown below:

Column 2,
Line 56, “0.06” should be -- 0.006 --.

Column 2,
Line 61, “0.32” should be -- 0.032 --.

Signed and Sealed this
Twenty-sixth Day of April, 2011

David J. Kappos

David J. Kappos
*Director of the United States Patent and Trademark Office*